US009657510B2

(12) United States Patent
Lu et al.

(10) Patent No.: US 9,657,510 B2
(45) Date of Patent: May 23, 2017

(54) INTEGRATED MULTI-FUNCTION WINDOW

(75) Inventors: Xianfeng Lu, Jishigang Town (CN); Jianhua Sang, Jishigang Town (CN)

(73) Assignee: NINGBO XIANFENG NEW MATERIAL CO., LTD., Yinzhou, Ningbo, Zhejiang Province (CN)

( * ) Notice: Subject to any disclaimer, the term of this patent is extended or adjusted under 35 U.S.C. 154(b) by 278 days.

(21) Appl. No.: 14/353,751

(22) PCT Filed: Aug. 23, 2012

(86) PCT No.: PCT/CN2012/080497

§ 371 (c)(1),
(2), (4) Date: Apr. 23, 2014

(87) PCT Pub. No.: WO2013/170557

PCT Pub. Date: Nov. 21, 2013

(65) Prior Publication Data

US 2015/0027059 A1 Jan. 29, 2015

(30) Foreign Application Priority Data

May 16, 2012 (CN) ..... 2012 2 0223245 U
Jul. 16, 2012 (CN) ..... 2012 2 0341473 U
Jul. 16, 2012 (CN) ..... 2012 2 0341993 U

(51) Int. Cl.
*A47H 1/00* (2006.01)
*E06B 3/67* (2006.01)
(Continued)

(52) U.S. Cl.
CPC ..... *E06B 3/6722* (2013.01); *E06B 3/66* (2013.01); *E06B 5/00* (2013.01); *E06B 7/28* (2013.01);
(Continued)

(58) Field of Classification Search
CPC . E06B 3/66; E06B 3/6722; E06B 9/42; E06B 9/581; E06B 9/582;
(Continued)

(56) References Cited

U.S. PATENT DOCUMENTS 3,065,785 A * 11/1962 Taber ..... A47H 23/04 160/237
3,420,026 A * 1/1969 Nolan ..... E06B 3/26347 29/509
(Continued)

FOREIGN PATENT DOCUMENTS

CN 2193913 Y 4/1995
CN 2210948 Y 10/1995
(Continued)

OTHER PUBLICATIONS

International Search Report for the Application No. PCT/CN2012/080497 mailed Feb. 28, 2013.

*Primary Examiner* — Katherine Mitchell
*Assistant Examiner* — Jeremy Ramsey
(74) *Attorney, Agent, or Firm* — NK Patent Law, PLLC

(57) ABSTRACT

The present invention discloses an integrated multi-function window in the technical field of building material, which overcomes the disadvantages of the existing windows, including complicated structures and time, labor and cost consuming double constructions. The integrated multi-function window includes a first window frame having a first window. A first window cover is mounted at the upper part of the first window frame and first telescopic curtain cloth is located within the first window cover. One side of the first window frame is fixedly connected to the second window frame having a second window. The position of the second window is corresponding to that of the first window. The integrated multi-function window has a simple configuration
(Continued)

and multiple functions and is of a low cost and improved reliability.

11 Claims, 17 Drawing Sheets

(51) Int. Cl.

| | |
|---|---|
| ***E06B 3/66*** | (2006.01) |
| ***E06B 5/00*** | (2006.01) |
| ***E06B 7/28*** | (2006.01) |
| ***E06B 9/42*** | (2006.01) |
| ***E06B 9/58*** | (2006.01) |
| *E06B 9/17* | (2006.01) |
| *E06B 9/24* | (2006.01) |

(52) U.S. Cl.
CPC ..... *E06B 9/42* (2013.01); *E06B 9/581* (2013.01); *E06B 9/582* (2013.01); *E06B 2009/17069* (2013.01); *E06B 2009/2452* (2013.01)

(58) Field of Classification Search
CPC ... E06B 2009/17069; E06B 2009/2452; E06B 3/2605
USPC ..... 160/25, 26, 273.1, 290.1, 31, 321, 98; 49/61, 62, 404, 125
See application file for complete search history.

(56) References Cited

U.S. PATENT DOCUMENTS

| | | | | |
|---|---|---|---|---|
| 5,445,209 | A * | 8/1995 | Lichy | E06B 9/13 160/273.1 |
| 6,123,135 | A * | 9/2000 | Mathews | E06B 9/40 160/24 |
| 2003/0136527 | A1* | 7/2003 | Weiss | A47F 3/0469 160/271 |
| 2011/0203748 | A1* | 8/2011 | Mullet | E06B 9/42 160/310 |

FOREIGN PATENT DOCUMENTS

| | | | |
|---|---|---|---|
| CN | 2839534 | Y | 11/2006 |
| CN | 101787836 | A | 7/2010 |
| CN | 102747925 | A | 10/2012 |
| CN | 102747926 | A | 10/2012 |
| DE | 36 44 557 | A1 | 7/1988 |
| FR | 2 717 531 | A1 | 9/1995 |
| GB | 2 211 878 | A | 7/1989 |

* cited by examiner

INTEGRATED MULTI-FUNCTION WINDOW

BACKGROUND OF THE INVENTION

Field of Invention

The present invention relates to the technical field of building materials, in particular, to an integrated window with energy saving, sun shading, heat insulating and heat preserving functions.

Related Art

The energy consumption of buildings now accounts for around 30% of the total energy consumption of the whole country with development of economy, of which the energy consumed by air conditioners account for around fifty percent. It is one of the most direct and effective energy saving means to provide the buildings with sunshades. However, sun-shading products are mounted so separately from the windows of buildings presently in this country that materials are wasted for repeated installation even though the energy saving effect could be achieved to some extent.

To this end, an integrally welding window frame profile for a single sliding window is disclosed in the Chinese Patent Publication No. CN101787836A, comprising a frame profile, a muntin frame profile, a small muntin profile and a sealing strip, in which a profile facade is provided at the frame profile and the muntin frame profile and small and medium-scale profiles are welded to the profile facades; a fundamental chute is positioned on the frame profile and the muntin frame profile, and the fundamental chute is connected with the chute heightening strip and the chute sealing strip in sequence; the sealing strip is provided with adhesive tape and wool top openings; and the adhesive tape opening is connected with screen window cloth having an adhesive tape. Even though the components for mounting the sliding window and those for mounting the curtain cloth are combined with each other to some extent in said window frame profile, the window frame profile has a large number of parts and a complicated structure and could not be conveniently mounted. Moreover, the position for mounting the window cover is only set on one surface of said window frame and the sun-shading effect could only be achieved in one single direction. If the user has to simultaneously mount indoor and outdoor sun-shading and mosquito proof curtain cloth, an additional mosquito proof curtain has to be mounted in an indoor position. As such, the problem for repetitive mounting still exits in the window frame, and the materials and human resources are wasted. In the meantime, the window frame formed by using said window frame profile still has a poor windproof property.

In conclusion, the conventional windows have such disadvantages that the outer windows are constructed by glass windows, which could permit daylight to pass through and control the flow of air into and out of rooms, but do not have the sun-shading or heat preserving function. Therefore, the user must additionally mount various sun-shading shades, covers and canopies outside of the windows, and mount various curtains within the room, which thus brings about double constructions. The existing windows have a complicated window structure and require time, labor and cost consuming double constructions.

SUMMARY OF THE INVENTION

In order to address the aforesaid problems existing in the prior art, the present invention provides an energy saving, sun shading, heat insulating, light permeable and heat preserving integrated multi-function window incorporating components for mounting the sliding window and components for mounting the curtain cloth, which has a simple and reliable configuration and good windproof performance. According to the invention, the window has multiple functions, which omits the process for mounting various functional elements and double construction, and saves time, labor and cost.

An object of the invention is to provide an integrated multi-function window comprising a first window frame having a first window. The window is provided with a window sash/sliding window, for example a translative and movable window sash. A first window cover is mounted at the upper part of the first window frame and first telescopic curtain cloth is located within the first window cover. One side of the first window frame is fixedly connected to the second window frame having a second window. The second window is provided with a window sash/sliding window, for example a translative and movable window sash. The position of the second window is corresponding to that of the first window.

Preferably, support portions and guide portions are symmetrically positioned on both sides of the first window frame. The support portion and guide portion on the same side are integrally molded. The upper end of the support portion is located higher than that of the guide portion. That is to say, an indentation is formed above the support portion and the guide portion on the same side. The first window cover is mounted at the indentations on both sides of the first window frame.

Preferably, an upper slide is connected between the upper ends of the support portions on both sides. A lower slide is connected between the lower ends of the support portions on both sides. The upper slide is corresponding to the lower slide to mount the movable window sash/sliding window.

Preferably, the said second window frame is formed and enclosed by vertical lateral seals on both sides, the upper slide connected between the upper ends of the lateral seals on both sides and the lower slide connected between the lower ends of the lateral seals on both sides. The upper slide is corresponding to the lower slide to mount the movable window sash/sliding window.

Preferably, a first groove is set on one side of the support portion of the first window frame in the longitudinal direction and a second groove is correspondingly set on one side of the lateral seal of the second window frame in the longitudinal direction. Both lateral edges of a plastic bar are respectively inserted and fixed into the first groove and second groove on the same side.

Preferably, the upper slide of the said first window frame is fixedly connected with the upper slide of the said second window frame; and/or the lower slide of the first window frame is fixedly connected with the lower slide of the said second window frame.

Preferably, the upper slide of the said first window frame is fixedly connected with the upper slide of the said second window frame through the second plastic bar; and the lower slide of the first window frame is fixedly connected with the lower slide of the said second window frame through the third plastic bar.

Preferably, a lateral seal limiting element is formed on the inner side of one of the lateral seals of the second window frame in the longitudinal direction for positioning the sliding window, and a window body limiting element is formed on the inner side of the support portion of the first window frame on the opposite side in the longitudinal direction for positioning another sliding window.

Preferably, a second window cover is mounted at the upper part of the second window frame and second telescopic curtain cloth is located within the second window cover.

Preferably, support portions and guide portions are symmetrically positioned on both sides of the second window frame. The support portion and guide portion on the same side are integrally molded. The upper end of the support portion is located higher than that of the guide portion. That is to say, an indentation is formed above the support portion and the guide portion on the same side. The second window cover is mounted at the indentations on both sides of the second window frame.

Preferably, in the second window frame, an upper slide is connected between the upper ends of the support portions on both sides and a lower slide is connected between the lower ends of the support portions on both sides. The upper slide is corresponding to the lower slide to mount the movable window sash/sliding window.

Preferably, a first groove is set on one side of the support portion of the said first window frame in the longitudinal direction and a second groove is correspondingly set on one side of the support portion of the said second window frame in the longitudinal direction. Both lateral edges of a plastic bar are respectively inserted and fixed into the first groove and second groove on the same side. The plastic bar has an I-shape section. In the process of mounting, two window frames are firstly aligned, the plastic bar is then aligned with and inserted into the first groove and second groove, and two long lateral edges of the plastic bar are respectively fixed within the first groove and second groove to connect said two window frames.

Preferably, the upper slide of the first window frame is fixedly connected with the upper slide of the second window frame; and/or the lower slide of the first window frame is fixedly connected with the lower slide of the said second window frame.

Preferably, the upper slide of the first window frame is fixedly connected with the upper slide of the second window frame through the second plastic bar; and the lower slide of the first window frame is fixedly connected with the lower slide of the second window frame through the third plastic bar.

Preferably, a window body limiting element is formed on the inner side of one of the support portions of the first window frame in the longitudinal direction for positioning the sliding window, and a window body limiting element is formed on the inner side of the support portion of the second window frame on the opposite side in the longitudinal direction for positioning another sliding window.

Preferably, a rotary reel pipe is mounted within the first window cover or the second window cover. Alternatively, a rotary reel pipe is mounted within each of the first window cover and the second window cover. The curtain cloth is wound around the outer surface of the reel pipe and the reel pipe is turned to drive the curtain cloth to wind or unwind. A longitudinal opening is located on the side of the guide portion facing the curtain cloth. A track is provided within the guide portion in the longitudinal direction and forms an open slot in the longitudinal direction, the opening of the open slot faces to one side of the curtain cloth, the upper opening of the open slot is in communication with the window cover, and a positioning element is mounted within the open slot along the longitudinal direction. Both lateral edges of the curtain cloth respectively pass through the longitudinal opening of the guide portion and the opening of the open slot on the same side, to extend into the open slot and be transversely located at the positioning element.

Preferably, the positioning element is a guide rod, the lower end of the guide rod is fixed and the upper end thereof faces opposite to the interior of the said window cover; and both lateral edges of the curtain cloth are respectively covered on the exterior of the guide rod on the same side and could be driven by the reel pipe to move up and down along the guide rod.

Preferably, the positioning element is a flexible tape; both lateral edges of the curtain cloth are respectively fixedly connected with the flexible tape on the same side or both lateral edges of the curtain cloth are respectively covered on the exterior of the flexible tape on the same side, and the upper end of the flexible tape is wound around the reel pipe. When the curtain cloth is unwound, the lower end of the flexible tape is fixed to transversely position the curtain cloth. When the lower end of the flexible tape is disengaged from the fixed position, the curtain cloth could be driven by the reel pipe to wind upwards.

Preferably, each of the lateral edges of the curtain cloth is fixedly connected with a hem, and the curtain cloth is transversely located at the positioning element through the hems.

Preferably, a tubular motor is mounted within the reel pipe and drives the reel pipe to rotate.

Preferably, a bottom plug is fixedly connected with the lower end of the guide portion and a positioning element is mounted on the bottom plug. The lower end of the guide rod is fixed on the said positioning element.

Preferably, a bottom plug is fixedly connected with the lower end of the guide portion and provided with a hook. When the curtain cloth is unwound, the lower end of the flexible tape is engaged with the hook of the bottom plug. When the lower end of the flexible tape is disengaged from the hook of the bottom plug, the curtain cloth could be driven by the reel pipe to wind upwards.

Preferably, a bead plate is externally secured to one end of the reel pipe and is driven to rotate by a pull bead, thereby driving the reel pipe to rotate synchronously.

Preferably, the lower edge of the curtain cloth is connected with a lower rod. After passing through the longitudinal opening of the guide portion and the opening of the open slot on the same side, both ends of the lower rod slidably extend into the open slot. The length of the lower rod coincides with the distance between the positioning elements on both sides.

Preferably, a concave slot is formed on the lower surface of the lower rod along its length. The slot is embedded into the rubber strip and the rubber strip partially projects from the lower surface of the lower rod.

Preferably, the first and second window covers are fixedly connected with the upper parts of the corresponding frame bodies by bolts respectively.

Preferably, in the first and second window frames, the support portions are made of hollow plates that are transversely and circumferentially closed and have openings at both longitudinal ends. As such, on the one hand, the reliability of the product could be guaranteed; and on the other hand, not only the production cost could be saved, but also good heat insulating performance could be obtained.

Preferably, two symmetrically disposed seal plugs are mounted within the guide portions of the first and second window frames adjacent to the end of the corresponding tracks. A gap is formed between said two seal plugs to pass the edge of the curtain cloth or hems and has a diameter smaller than the outer diameter of the guide rod.

Preferably, the reel pipe can be made of an aluminum pipe. End caps are provided on both ends of the window covers. Heat dissipation holes could be provided on the end caps.

Preferably, a bottom plug is mounted at each lower end face of the guide portion and a guide plug is mounted at each upper end face of the guide portion. A positioning element is mounted within the bottom plug. One end of the guide rod is inserted into the positioning element and the other end thereof passes through the guide plug. The impurities, such as dust, will be prevented from entering into the window frame guide portion by the bottom plug and guide plug. The track within the window frame guide portion will be kept tidy to prevent too many impurities blocking the track to make it difficult to move the curtain cloth up and down.

Preferably, an elliptical groove is disposed on the positioning element. The guide rod is inserted into the elliptical groove. The distance between said two guide rods can be varied by locating the guide rods in different positions within the elliptical groove, so that the curtain cloth of different widths can be mounted. Meanwhile, when the wind is strong, the movement of said two guide rods within the corresponding elliptical grooves ensures that the curtain cloth can be smoothly moved. The curtain cloth can be slightly and appropriately projected to prevent itself from being torn down by wind for over-straightening reasons.

The energy saving, sun shading, heat insulating and heat preserving integrated multi-function window of the invention has the following technical effects.

Firstly, the existing windows are simplified by the invention. According to the invention, revolutionary improvements have been made to conventional outer windows to organically integrate the energy saving, sun shading, heat insulating and heat preserving outdoor sun shading curtains, glass windows and indoor windows into one piece. Therefore, a multi-function constructive window will be formed and windproof devices can be disposed on both vertical edges of the window frames.

Secondly, the window of the invention has a number of functions. It is widely known that outdoor sun-shading curtains and indoor curtains are additionally mounted on the outer windows to efficiently reduce heat radiation of sunshine entering into rooms and outflow of indoor heat. With the development of human demands and technological levels, in order to prevent the sun-shading curtains or ordinary curtains drifting because of the wind, the designers have made several tries but have not obtained ideal results.

However, the present invention has organically combined translative windows, outdoor sun-shading curtains and indoor curtains together to form a new outer window. The functions of translative windows, outdoor sun-shading curtains and indoor curtains are incorporated into one single window. The benefits of translative windows, outdoor sun-shading curtains and indoor curtains can be obtained by one single window of the invention. Therefore, a large amount of raw materials can be saved and the cost of materials can be reduced. In order to improve the windproof performance of the outdoor sun shading curtains and indoor curtains, windproof components are additionally provided within the vertical edges of the integrated window frames in the invention. The windproof mechanism formed as such can efficiently overcome the drifting of the curtain cloth because of the wind pressure.

Thirdly, the materials can be saved and the cost can be reduced. If the functions of the window of the invention are to be obtained in the prior art, sun shading curtains have to be made and mounted outside of the outer windows, curtains have to be made and mounted inside of the outer windows, and outer windows have to be made and mounted when the house is built, for which three process have to be fulfilled. On the other hand, the window of the invention can be mounted at one time when the house is to be built. As such, not only the production cost is reduced, but also the construction times are decreased. Therefore, the construction process is expedited and the cost for mounting and construction is reduced.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1:
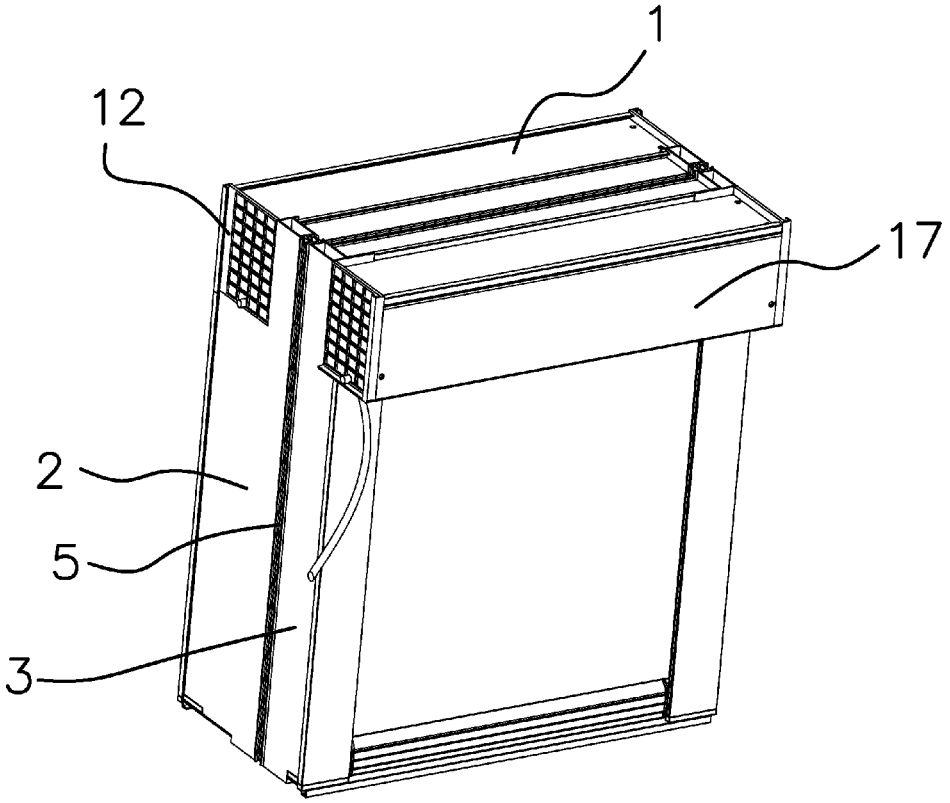
FIG. 1 is a schematic diagram of the integrated multi-function window according to the first embodiment of the invention.
Figure 2:
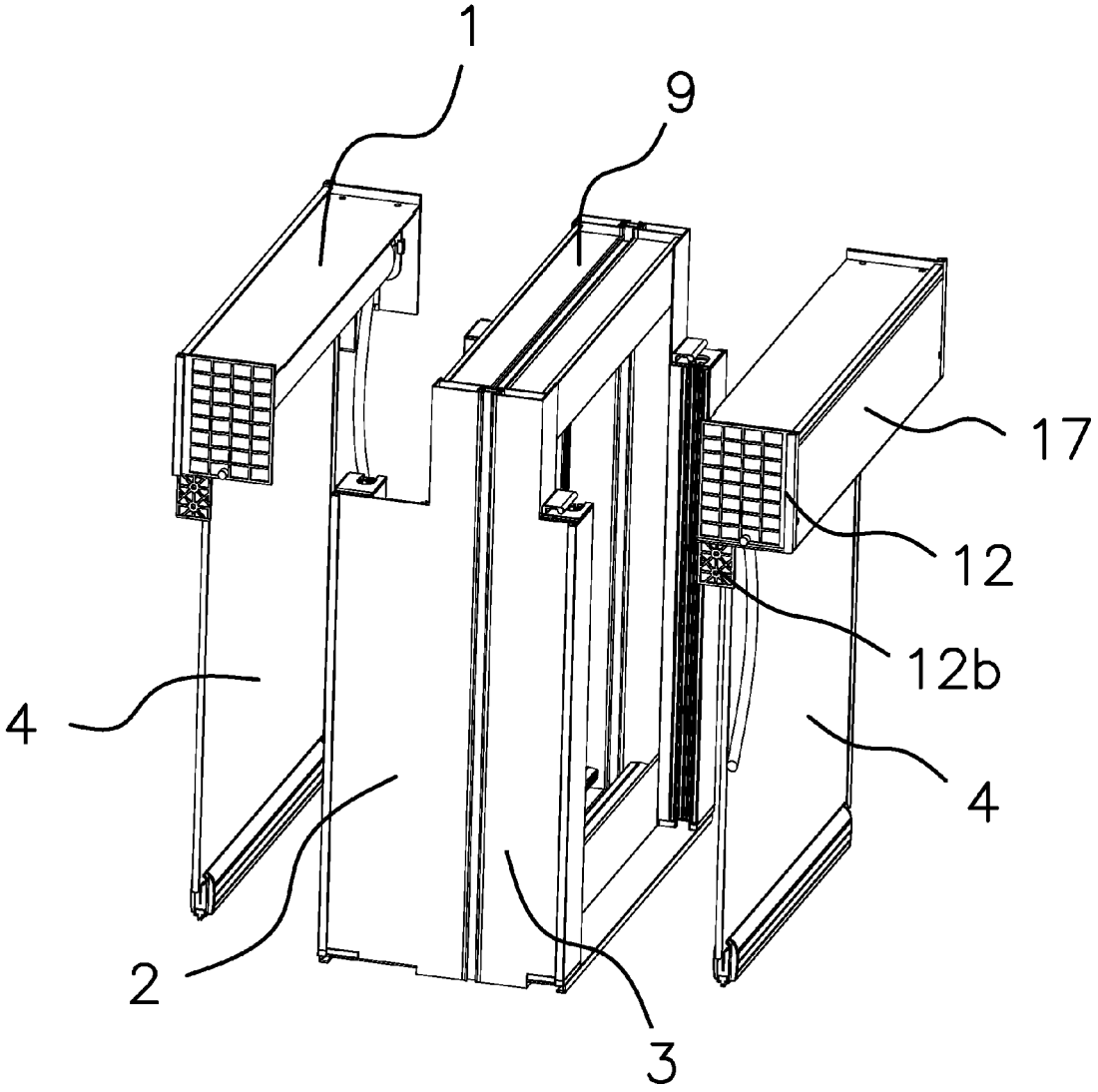
FIG. 2 is an exploded view of the integrated multi-function window according to the first embodiment of the invention.
Figure 3:
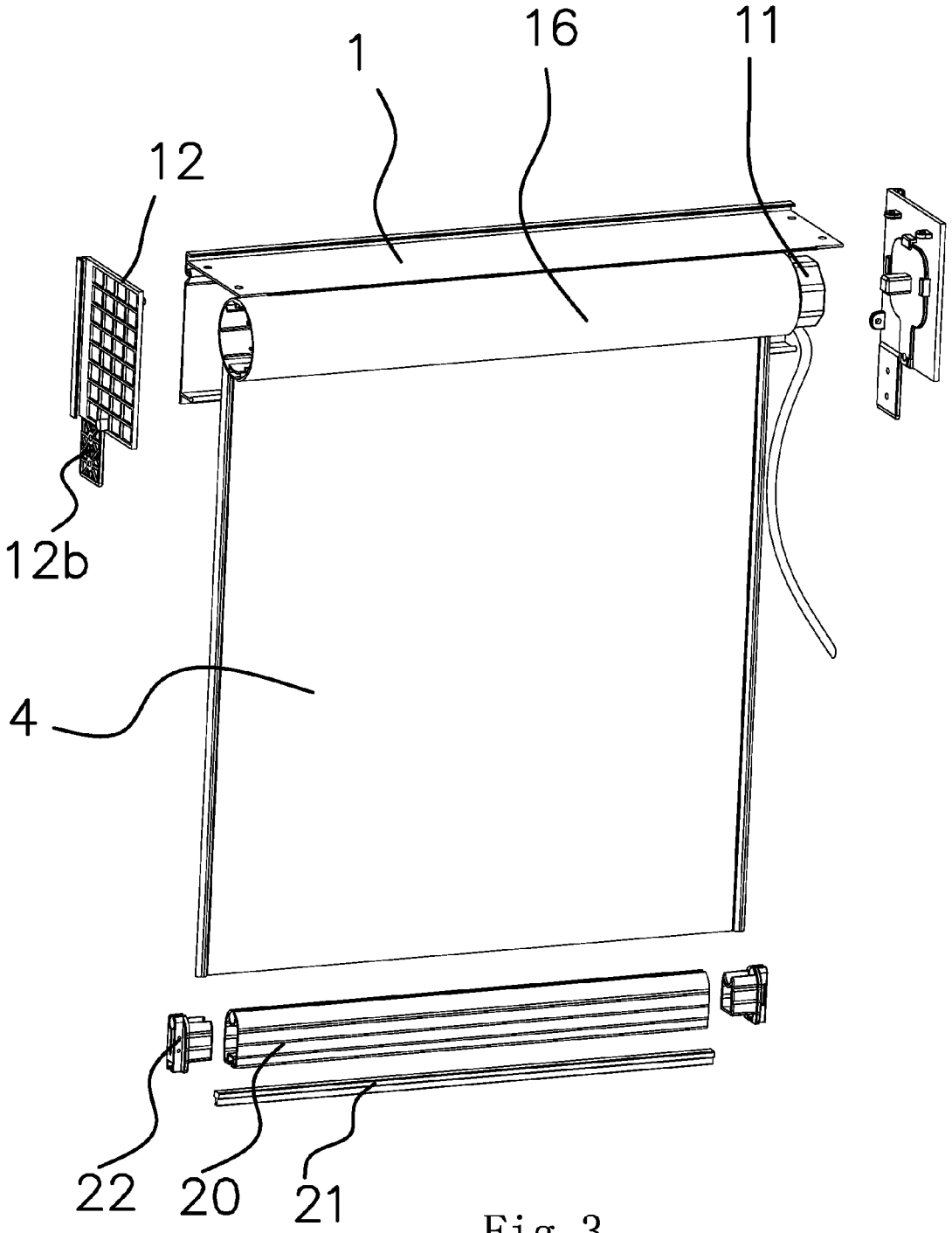
FIG. 3 is an exploded view of the front window cover according to the first embodiment of the invention.
Figure 4:
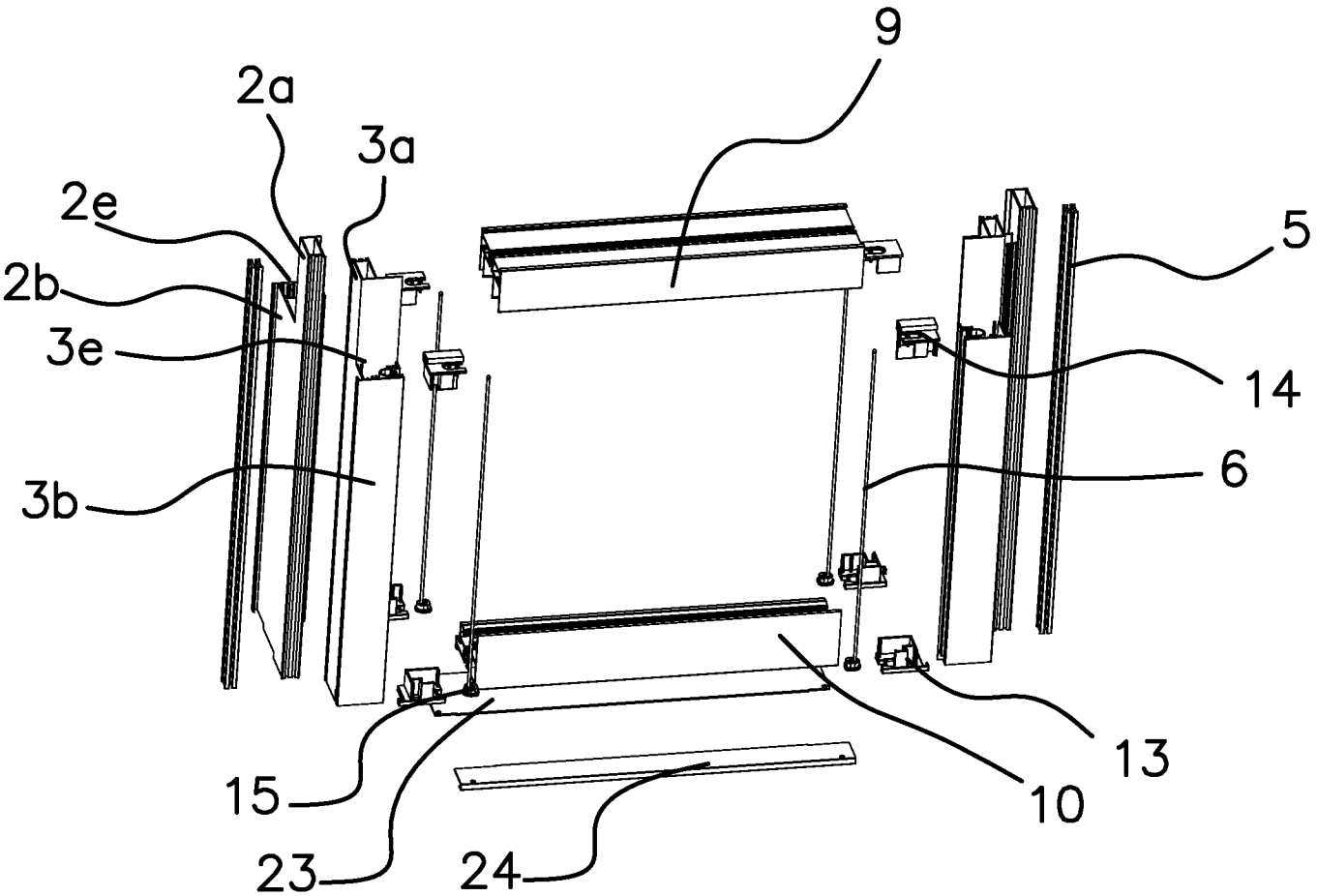
FIG. 4 is an exploded view of the window frame according to the first embodiment of the invention.
Figure 5:
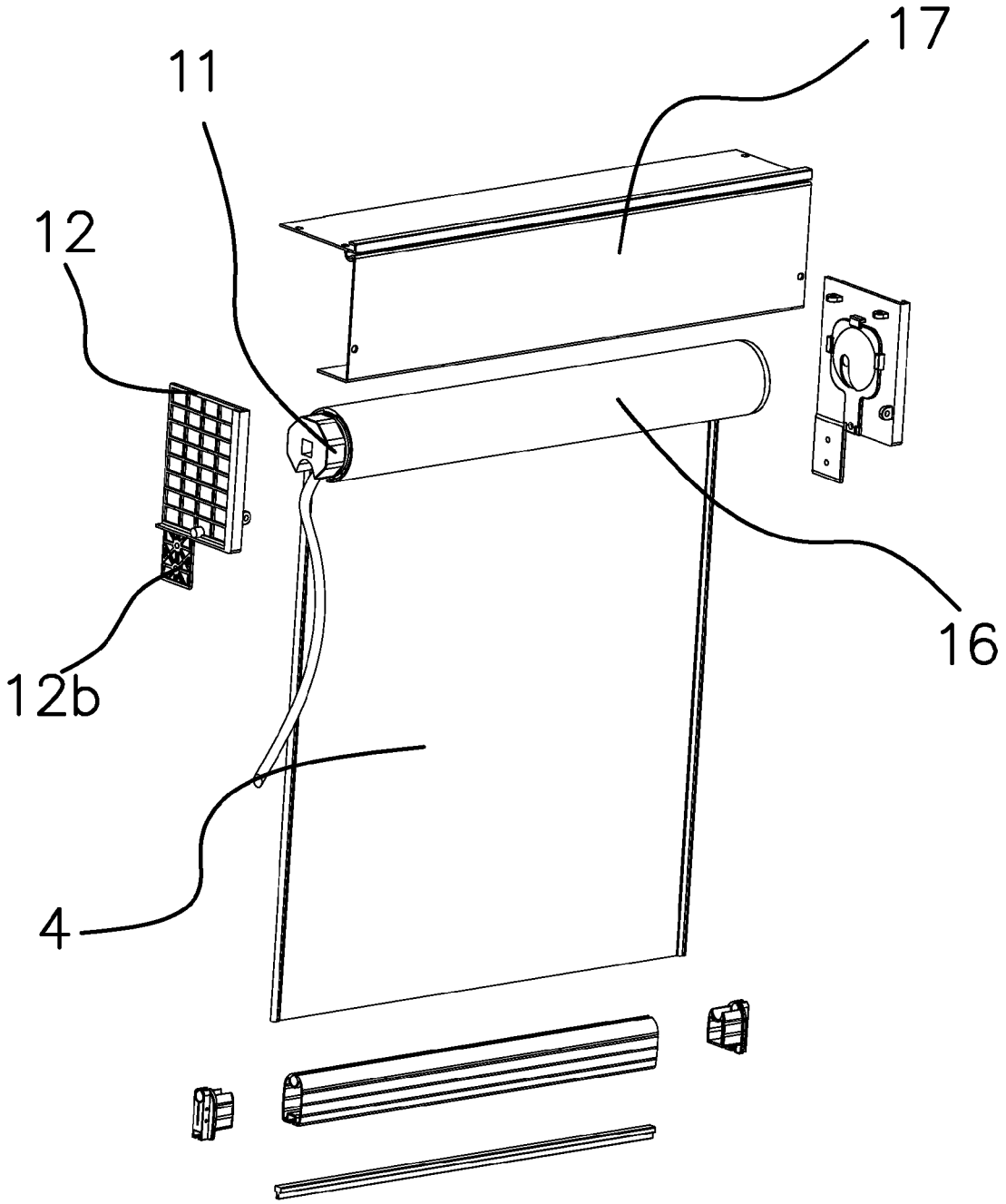
FIG. 5 is an exploded view of the back window cover according to the first embodiment of the invention.
Figure 6:
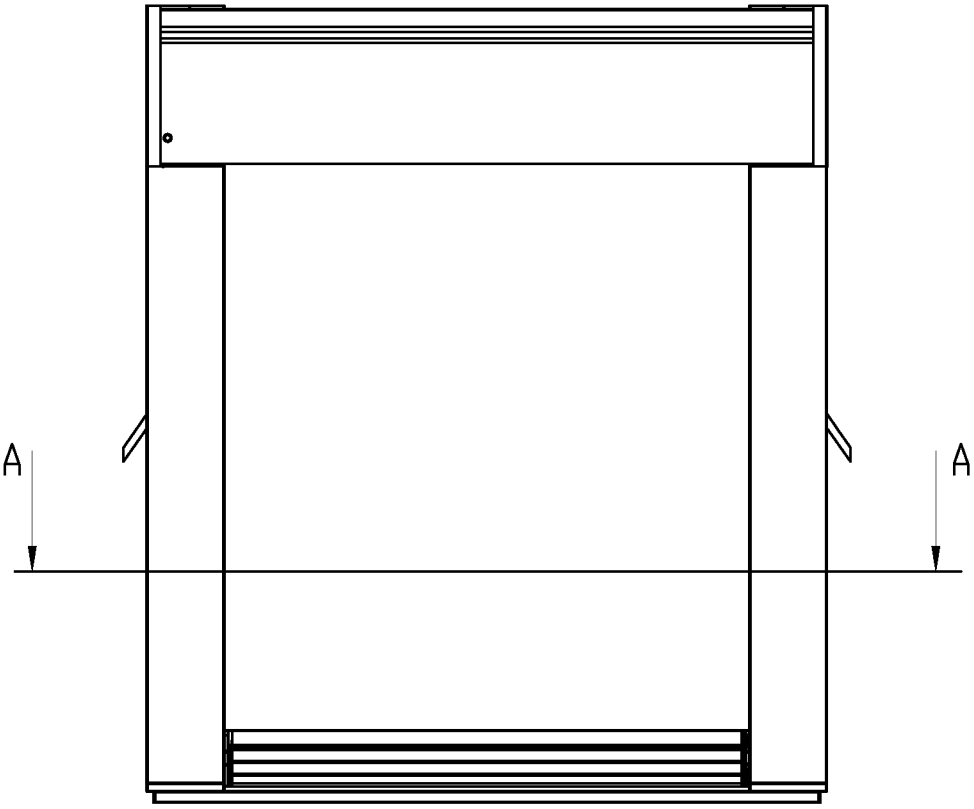
FIG. 6 is a front view of the integrated multi-function window according to the first embodiment of the invention.
Figure 7:
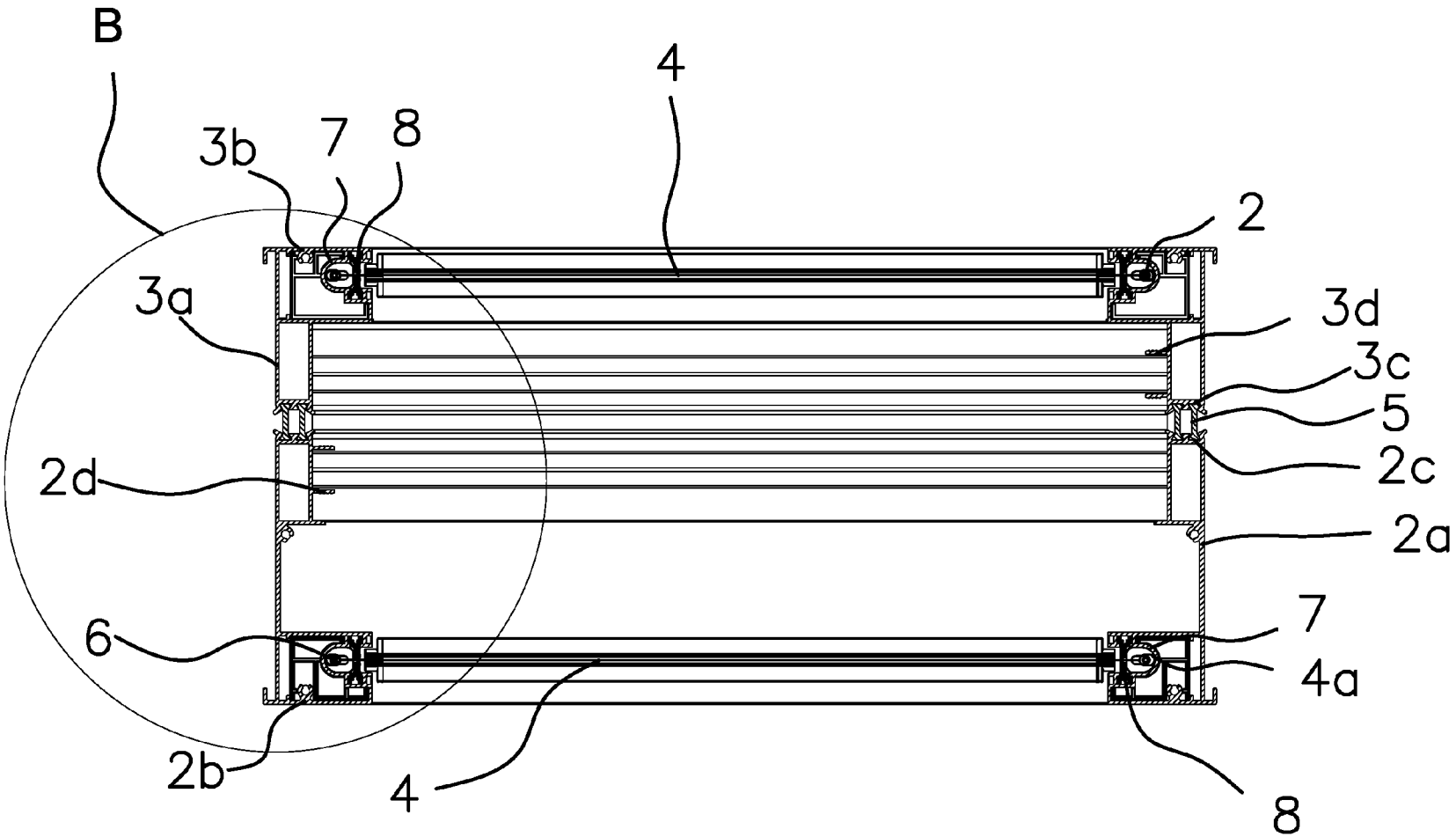
FIG. 7 is a sectional view taken along the line A-A of FIG. 6.
Figure 8:
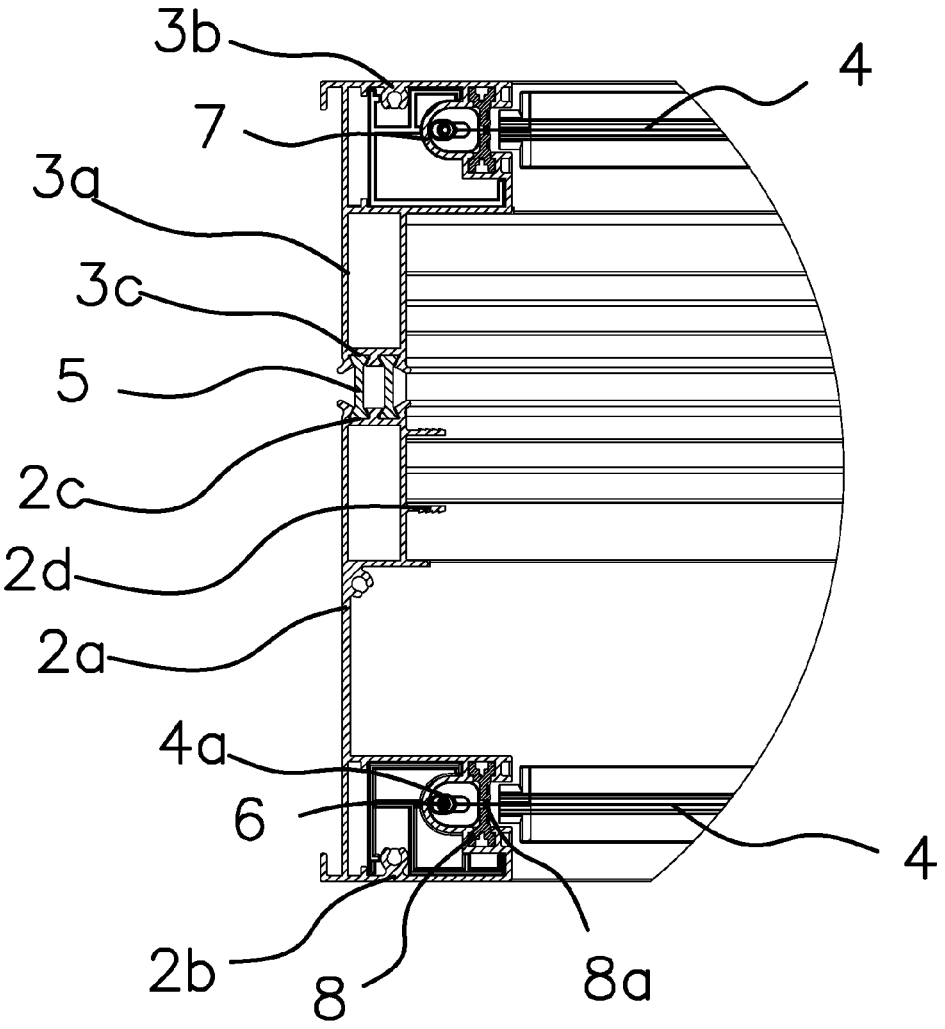
FIG. 8 is an enlarged diagram of the portion B of FIG. 7.
Figure 9:
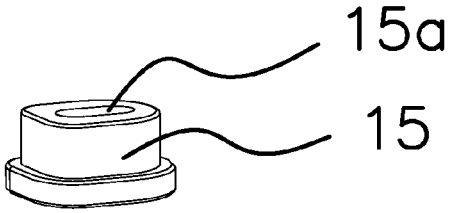
FIG. 9 is a schematic diagram of the positioning element according to the first embodiment of the invention.
Figure 10:
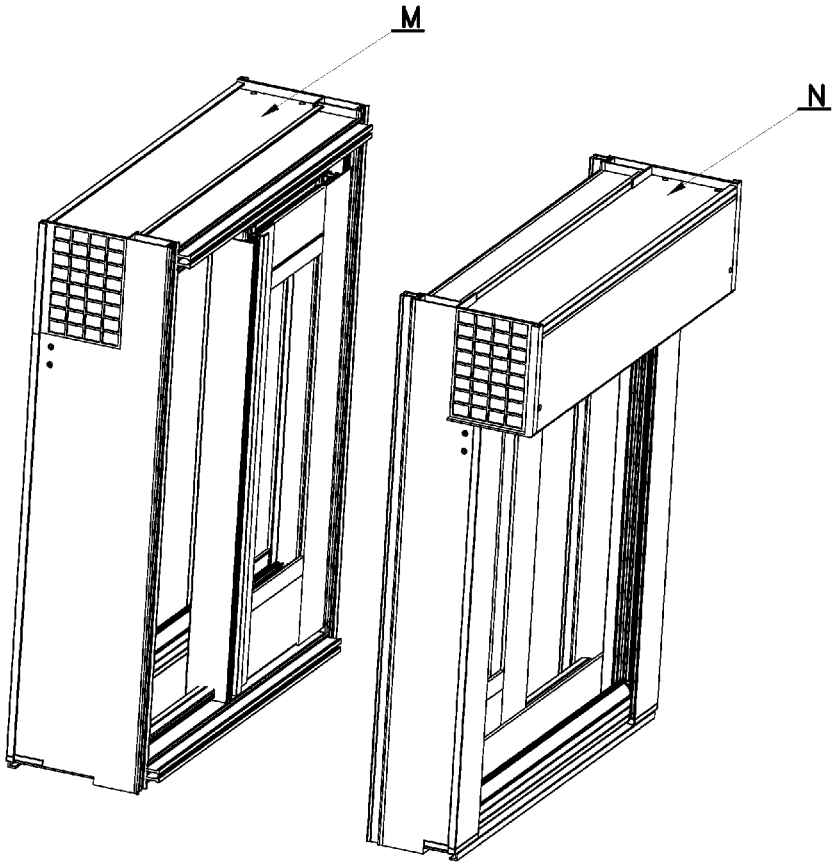
FIG. 10 is a schematic diagram of the indoor and outdoor window frames having a translative window sash.
Figure 11:
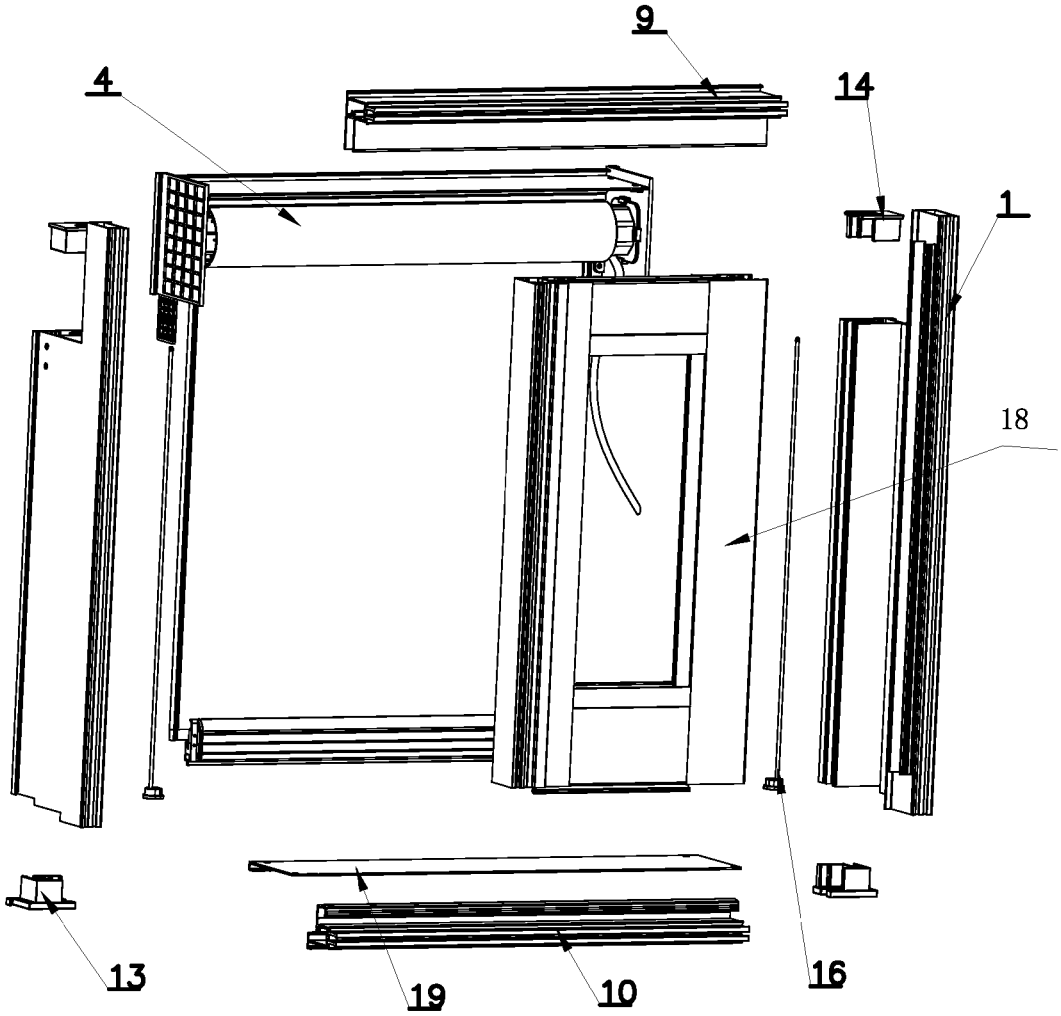
FIG. 11 is an exploded view of the portion M of FIG. 10, in which the outdoor window frame is the front window frame.
Figure 12:
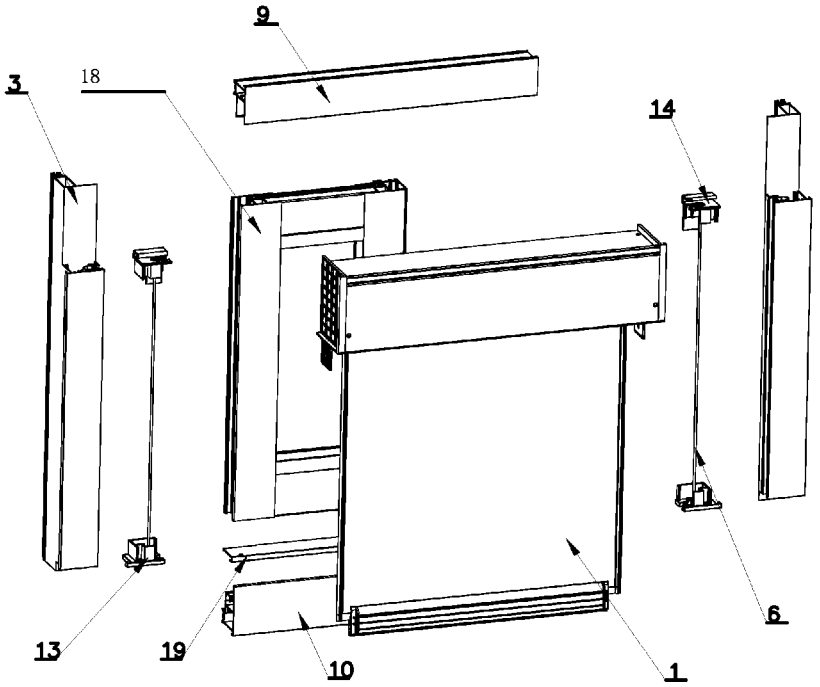
FIG. 12 is an exploded view of the portion N of FIG. 10, in which the indoor window frame is the back window frame.
Figure 13:
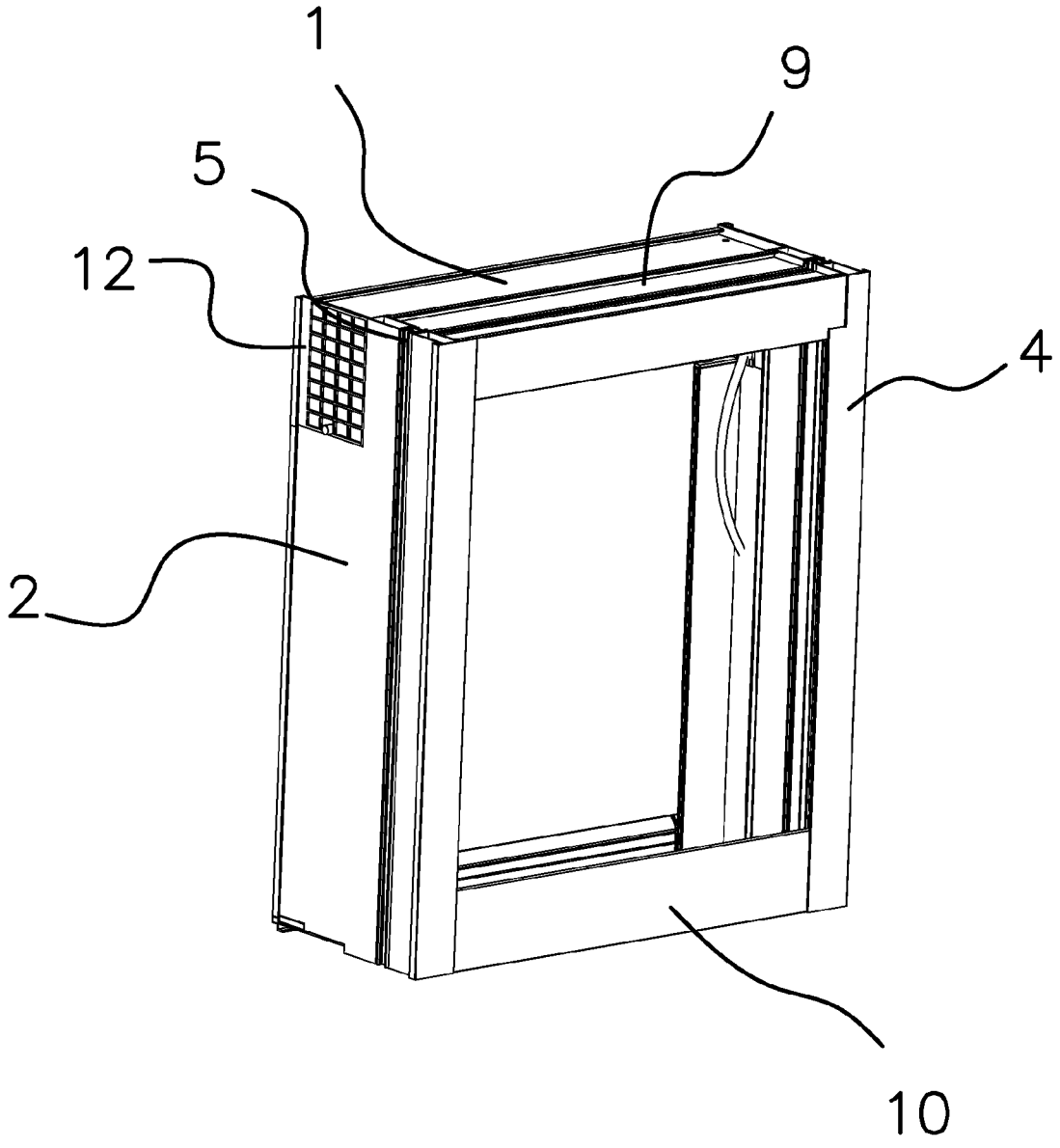
FIG. 13 is a schematic diagram of the integrated multi-function window according to the second embodiment of the invention.
Figure 14:
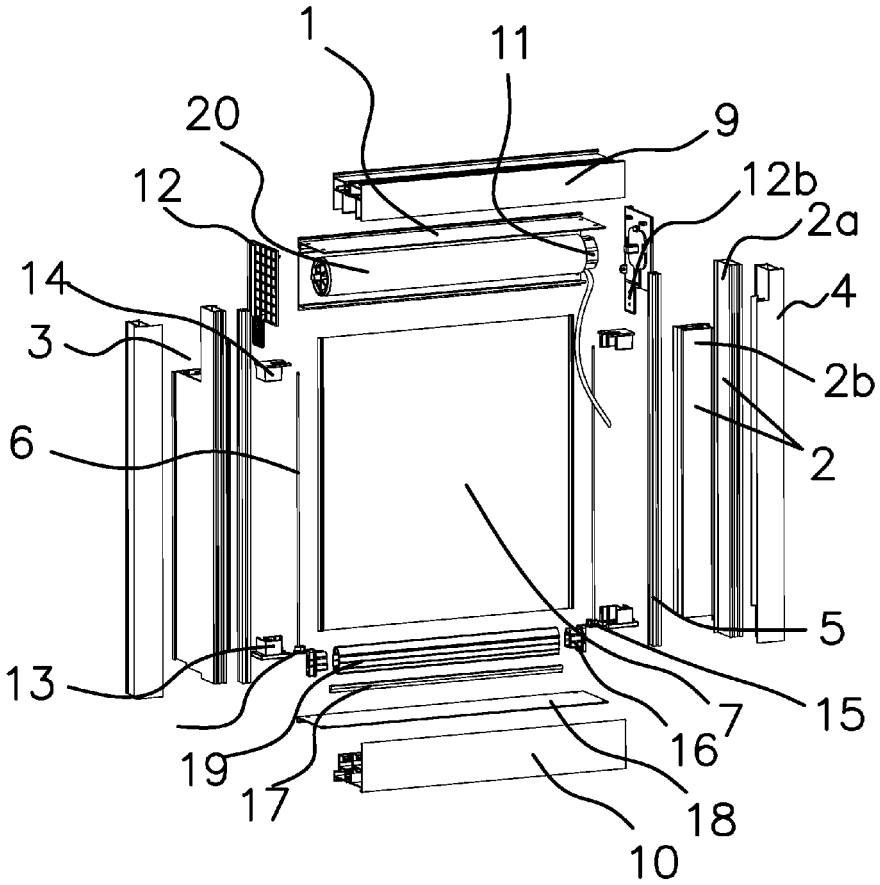
FIG. 14 is an exploded view of the integrated multi-function window according to the second embodiment of the invention.
Figure 15:
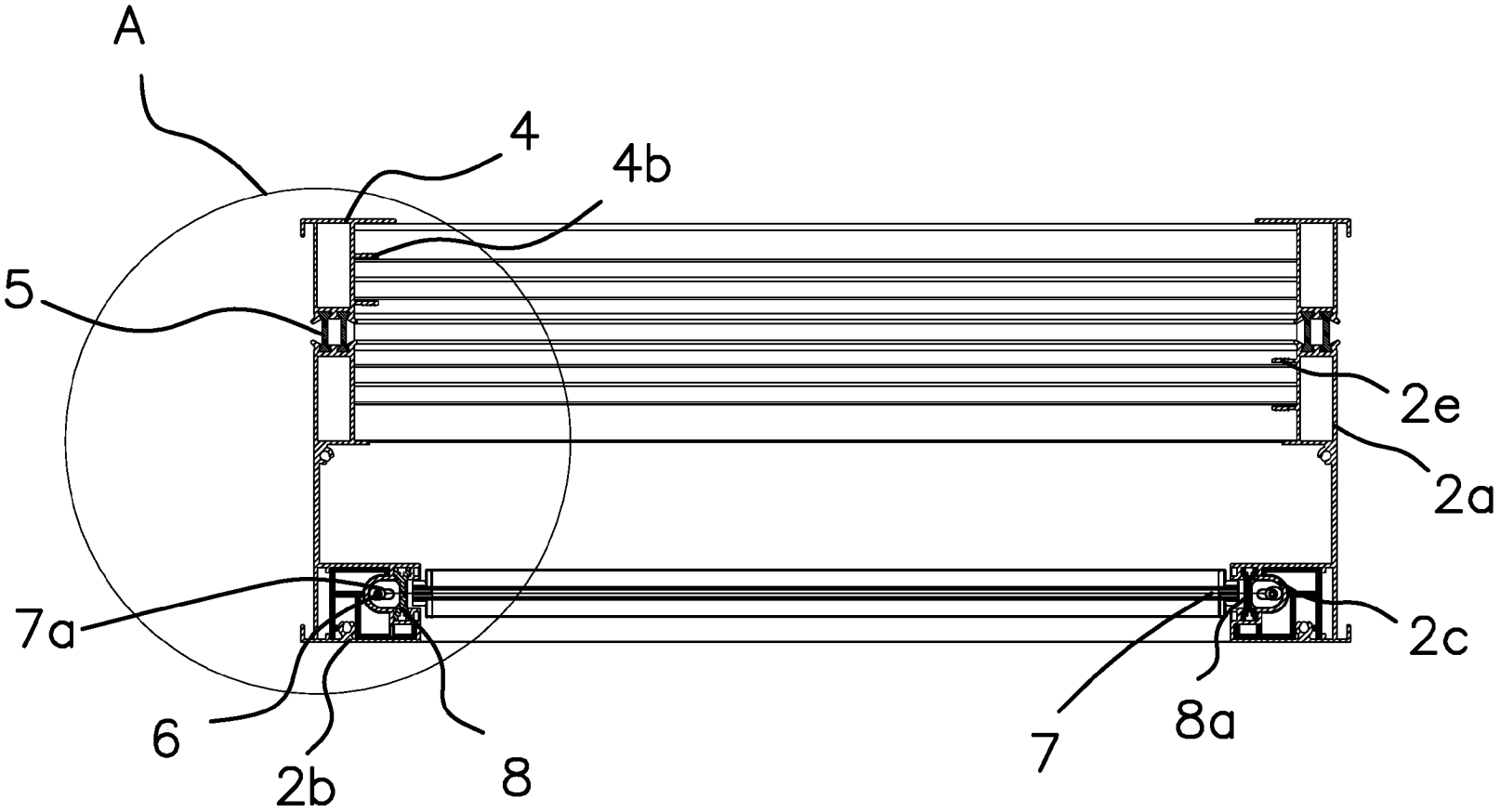
FIG. 15 is a sectional view of the integrated multi-function window according to the second embodiment of the invention.
Figure 16:
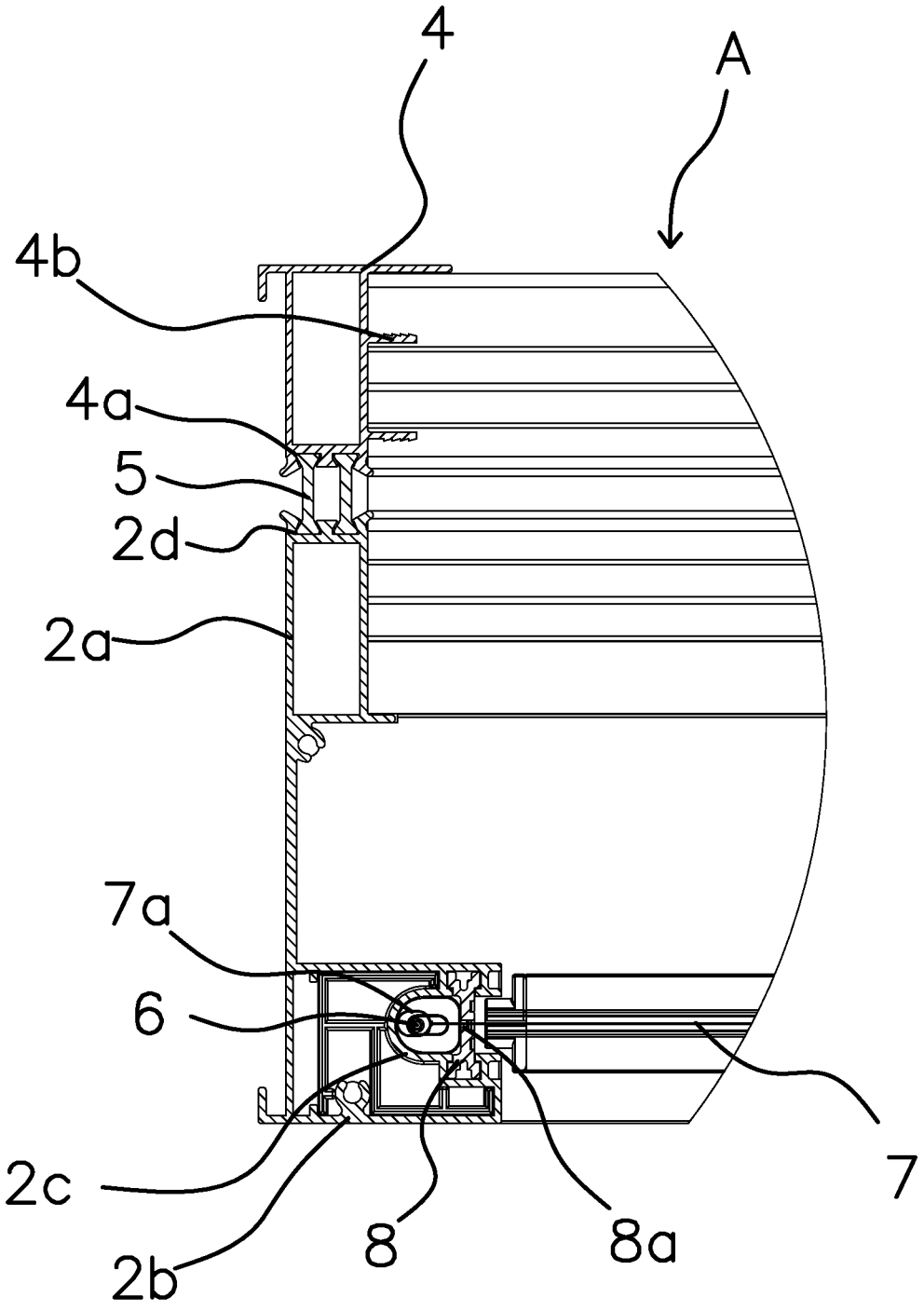
FIG. 16 is an enlarged diagram of the portion A of FIG. 15.
Figure 17:
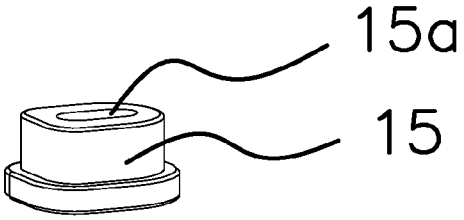
FIG. 17 is a schematic diagram of the positioning element according to the second embodiment of the invention.

Embodiments of the present invention will be described in detail below with reference to the drawings, and the technical solutions of the invention will be further illustrated. However, the scope of the invention is not limited to these embodiments.

First Embodiment

In this embodiment, an integrated window has front and back window frames, as shown in FIGS. 1-12. The front and back window frames have the same structural principle, for which the structures of the window frames will be specifically described as follows.

Two front frame bodies 2 are symmetrically located on both sides of the front window frame. The front frame body 2 has a front support portion 2*a* and a front guide portion 2*b*. The front frame body is configured as an elongated L-shape. That is to say, the front support portion 2*a* is vertically connected with the front guide portion 2*b*, and an indentation 2*e* is formed above the front support portion 2*a* and the front guide portion 2*b*, in which the upper end of the front support portion is located higher than the front guide portion. In this embodiment, the front support portion 2*a* is integrated with the front guide portion 2*b*.

A front window cover 1 is mounted on the front frame bodies 2. The indentation 2*e* formed between the front guide portion 2*b* and the front support portion 2*a* has a width identical to that of the window cover. In the process of mounting, the front window cover is fixed at the said front indentation 2*e*, so that the front window cover 1 will not be lonely exposed and projected to the external environment. As such, the front portion of the window, i.e. the portion exposed at the external wall, is configured as a square shape, which provides the window with an overall attractive appearance.

An upper slide 9 is provided between the upper ends of the support portions of the front frame bodies on both sides, and a lower slide 10 is provided between the lower ends thereof. The upper and lower slides are provided with corresponding slide ways, which are mainly used to facilitate horizontal movement of the sliding window between left and right. The bottom surface of the lower slide 10 is covered by the outer window frame sealing plate 23.

Two back frame bodies 3 are symmetrically located on both sides of the back window frame. The back frame body 3 has a back support portion 3*a* and a back guide portion 3*b*. The back frame body is configured as an elongated L-shape. That is to say, the back support portion 3*a* is vertically connected with the back guide portion 3*b*, and an indentation 3*e* is formed above the front support portion 3*a* and the front guide portion 23*b*, in which the upper end of the back support portion is located higher than the back guide portion. In this embodiment, the back support portion 3*a* is integrated with the back guide portion 3*b*.

A back window cover 17 is mounted on the back frame bodies 3. The indentation 3*e* formed between the back guide portion 3*b* and the back support portion 3*a* has a width smaller than that of the back window cover 17. As the back frame bodies 3 are faced to the interior of the room, the back frame bodies 3 can not extend out of the wall for the purpose of attraction and harmony of the whole product. The back window cover 17 shall have a relatively large area because a tubular motor 11 has to be mounted within the back window cover 17. Therefore, the width of the indentation 3*e* formed between the back guide portion 3*b* and the back support portion 3*a* is configured to be smaller than the width of the back window cover 17 in the back frame bodies 3, so that the back window cover 17 could individually extend beyond the wall.

An upper slide 9 is provided between the upper ends of the support portions of the back frame bodies on both sides, and a lower slide 10 is provided between the lower ends thereof. The upper and lower slides are provided with corresponding slide ways, which are mainly used to facilitate horizontal movement of the sliding window between left and right. The bottom surface of the lower slide 10 is covered by the inner window frame sealing plate 24.

In this embodiment both the front window cover 1 and the back window cover 17 are respectively fixed to the upper part of the front frame bodies and the lower part of the back frame bodies by bolts.

The front support portion 2*a* is fixedly connected with the back support portion 3*a* by means of a plastic bar 5. In particular, a first groove 2*c* is set on one side of the front support portion 2*a* and a second groove 3*c* is set on one side of the back support portion 3*a* corresponding to the first groove 2*c*. Two long lateral edges of the plastic bar are respectively inserted into and fixed to the first groove 2*c* and the second groove 3*c*. The plastic bar 5 has an I-shape section. In the process of mounting, the front frame body 2 is firstly aligned with the back frame body 3, the plastic bar 5 is then aligned with and inserted into the first groove 2*c* and second groove 3*c*, and two long lateral edges of the plastic bar 5 are fixed within the first groove 2*c* and second groove 3*c* to connect the front frame body 2 with the back frame body 3. As such, the front frame bodies 2 can be readily mounted to the back frame bodies 3. The window frames are integrally made from aluminum alloy materials. The front support portions 2*a* of the front frame bodies 2 and the back support portions 3*a* of the back frame bodies 3 are made of hollow plates that are transversely and circumferentially closed and have openings at both longitudinal ends. As such, on the one hand, the reliability of the whole product could be guaranteed; and on the other hand, not only the production cost could be saved, but also good heat insulating performance could be obtained.

When the front and back window frames are connected by using the plastic bars, the corresponding upper and lower slides thereof are fixedly connected with each other as well. Particularly, said two upper slides are connected via a plastic bar which is heat insulating, and said two lower slides are connected via another plastic bar which is heat insulating.

A front frame body limiting element 2*d* is located on the inner side of one of the front support portions 2*a* for positioning the sliding window, and a back frame body limiting element 3*d* is located on the inner side of the back support portion 3*a* on the opposite side for positioning another sliding window. As such, the sliding windows could be conveniently mounted and positioned by using said two limiting elements.

Each of the front window cover 1 and the back window cover 17 has a curtain cloth rolling mechanism located therein. In this embodiment, each of the curtain cloth rolling mechanisms has a tubular motor 11 mounted within the aluminum-made reel pipe 16. The upper edges of the said both pieces of curtain cloth 4 are respectively fixedly connected to the wall of the corresponding aluminum pipes 16. The curtain cloth 4 is wound around the outer surface of the aluminum pipe 16. This way, the reel pipes 16 could be driven to rotate by actuating the tubular motors 11 to automatically move the curtain cloth 4 up and down, so that the curtain cloth 4 is unwound or wound.

End caps 12 are provided on both ends of the front and back window covers and are rotatably matched with the reel pipe 16. Extension elements 12*b* are provided on the end caps 12. The end caps 12 could be fixedly connected with the window frame support portions by inserting the extension elements 12*b* into the window frame support portions. As such, the overall reliability of the curtain could be guaranteed. The curtain cloth 4 mounted on the front window cover 1 which is located on the exterior wall, is made from sun-shading materials, and the curtain cloth 4 mounted on the back window cover 17 which is located within the room, is made from screen window cloth. Therefore, the said two pieces of curtain cloth 4 could be respectively pulled down as required, which could respectively act to prevent sunshine entering into the room and shield mosquitoes and wind. Heat dissipation holes could be provided on the end caps 12.

Each of the front guide portions 2*b* of the front frame bodies 2 and the back guide portions 3*b* of the back frame bodies 3 has a track 7 located therein. In particular, the track 7 is integrated with the corresponding guide portion to facilitate the manufacturing process. A longitudinal opening is located on the side of the guide portion 2*b* facing the curtain cloth 4. The track 7 forms an open slot in the longitudinal direction and the opening of the open slot faces to one side of the curtain cloth 4. The upper opening of the open slot is in communication with the window cover 1. A guide rod 6 is located within the open slot in the longitudinal direction. Two symmetrically disposed seal plugs 8 are mounted within the front guide portion 2*b* and the back guide portion 3*b* adjacent to the end of the track 7. A gap 8*a* is formed between said two seal plugs 8 and has a diameter smaller than the outer diameter of the guide rod 6. Both lateral edges of the curtain cloth 4 respectively pass through the longitudinal opening of the guide portion 2*b* and the opening of the open slot on the same side, to extend into the open slot 21 and be transversely positioned at the guide rod 6.

Both lateral edges of said two pieces of window cloth 4 are fixedly connected with a hem 4*a* which passes through the gap 8*a* between two seal plugs 8 to be covered on the guide rod 6 and moves up and down along the guide rod 6. The hems 4*a* are cloth made from ordinary nylon composite materials or ordinary chemical fiber materials, have a tensible feature and thus tend not to be broken. The hems 4*a* can be folded in two to form a circumferentially closed space into which the guide rod 6 is inserted, so that the guide rod 6 is connected with the curtain cloth 4. While the hem 4*a* is wound up with the curtain cloth 4, the hem 4*a* is flattened, has a thickness identical to that of the curtain cloth 4 and constantly remains flat to prevent the window cloth 4 from being displaced. As such, when the wind blows to the window cloth 4, the curtain cloth 4 is caught by two guide rods 6 through the hems 4*a* and is pulled straight, which ensures the guide rod 6 be always restricted within the track 7 to prevent from being removed. The curtain cloth 4 and the hems 4*a* can be welded together by using a heat sealing device under the temperature of 200-400° C. or sewed to each other by using a sewing machine.

A bottom plug 13 is mounted at the lower end face of the window frame guide portion and a guide plug 14 is mounted at the upper end face of the guide portion. A positioning element 15 is mounted within the bottom plug 13. One end of the guide rod 6 is inserted into the positioning element 15 and the other end thereof passes through the guide plug 14. The impurities, such as dust, will be prevented from entering into the window frame guide portion by the bottom plug 13 and guide plug 14. The track 7 within the window frame guide portion will be kept tidy to prevent too many impurities blocking the track 7 to make it difficult to move the curtain cloth 4 up and down.

An elliptical groove 15*a* is disposed on the positioning element 15. The guide rod. 6 is inserted into the elliptical groove 15*a*. The distance between said two guide rods 6 can be varied by locating the guide rods 6 in different positions within the elliptical groove 15*a*, so that curtain cloth 4 of different widths can be mounted. Meanwhile, when the wind is Strong, the movement of said two guide rods 6 within the corresponding elliptical grooves 15*a* ensures that the curtain cloth 4 can be smoothly moved. The curtain cloth 4 can be slightly and appropriately projected to prevent itself from being torn down by wind for over-straightening reasons.

The lower edge of the curtain cloth is connected with a lower rod 20. After passing through the longitudinal opening of the guide portion and the opening of the open slot on the same side, both ends of the lower rod 20 slidably extend into the open slot. The length of the lower rod 20 coincides with the distance between the guide rods on both sides. The lower rod is hollow and both ends thereof are sealed by a rod plug 2 respectively. A rubber strip 21 is mounted on the lower surface of the lower rod 20 along its length. A concave slot is formed on the lower surface of the lower rod 20 along its length. The slot is embedded into the rubber strip 21 and the rubber strip 21 partially projects from the lower surface of the lower rod 20.

Second Embodiment

This embodiment is different from the first embodiment in that one of the window frames does not have window covers, curtain cloth or other parts. The structure of the second embodiment will be described below.

As shown in FIGS. 13-17, the support portion 2*a* is fixedly connected with a lateral seal via a plastic bar 5. In particular, a first groove 2*d* is provided on a side of the support portion 2*a* and a second groove 4*a* is provided on a side of the lateral seal 4 corresponding to the first groove 2*d*. Both ends of the plastic bar 5 are inserted into and fixed to the first groove 2*d* and the second groove 4*a* respectively. The plastic bar 5 has an I-shape section. In the process of mounting, the lateral seal 4 is firstly aligned with the frame body 2, the plastic bar 5 is then aligned with and inserted into the first groove 2*d* and second groove 4*a*, and two long lateral edges of the plastic bar 5 are fixed within the first groove 2*d* and second groove 4*a* respectively to connect the lateral seal 4 with the frame body 2, in which case the lateral seal is conveniently mounted to the frame body. Both the window frames and the lateral seals are made from aluminum alloy materials. The front support portions 2*a* of the frame bodies 2 and the lateral seals are made of hollow plates that are transversely and circumferentially closed and have openings at both longitudinal ends. As such, on the one hand, the reliability of the whole product could be guaranteed; and on the other hand, not only the production cost could be saved, but also good heat insulating performance could be obtained.

A lateral seal limiting element 4*b* is located on the inner side of one of the lateral seals 4 for positioning the sliding window, and a frame body limiting element 2*e* is located on the inner side of the support portion 2*a* of the frame body 2 on the opposite side for positioning another sliding window. As such, the sliding windows could be conveniently mounted and positioned by using said two limiting elements.

An upper slide 9 is provided between the upper ends of the lateral seals on both sides, and a lower slide 10 is provided between the lower ends thereof. The upper and lower slides are provided with corresponding slide ways, which are mainly used to facilitate horizontal movement of the sliding window between left and right.

When the window frames are connected with the lateral seals by using the plastic bars, the corresponding upper and lower slides thereof are fixedly connected with each others as well. Particularly, said two upper slides are connected via a plastic bar which is heat insulating, and said two lower slides are connected via another plastic bar which is heat insulating.

In this embodiment, the window frame having the window cover is mainly applied to outer sun-shading windows, and thus the lateral seal 4 is located within the room and the frame body 2 is located outside of the room. In other words, the window cover 1 is positioned out of the room.

The curtain cloth 7 is made from sun shading materials, in which case sunshine can be effectively prevented from entering the room when the curtain cloth 7 is pulled down.

The other aspects of the second embodiment could refer to those described in the first embodiment.

Third Embodiment

Figure 18:
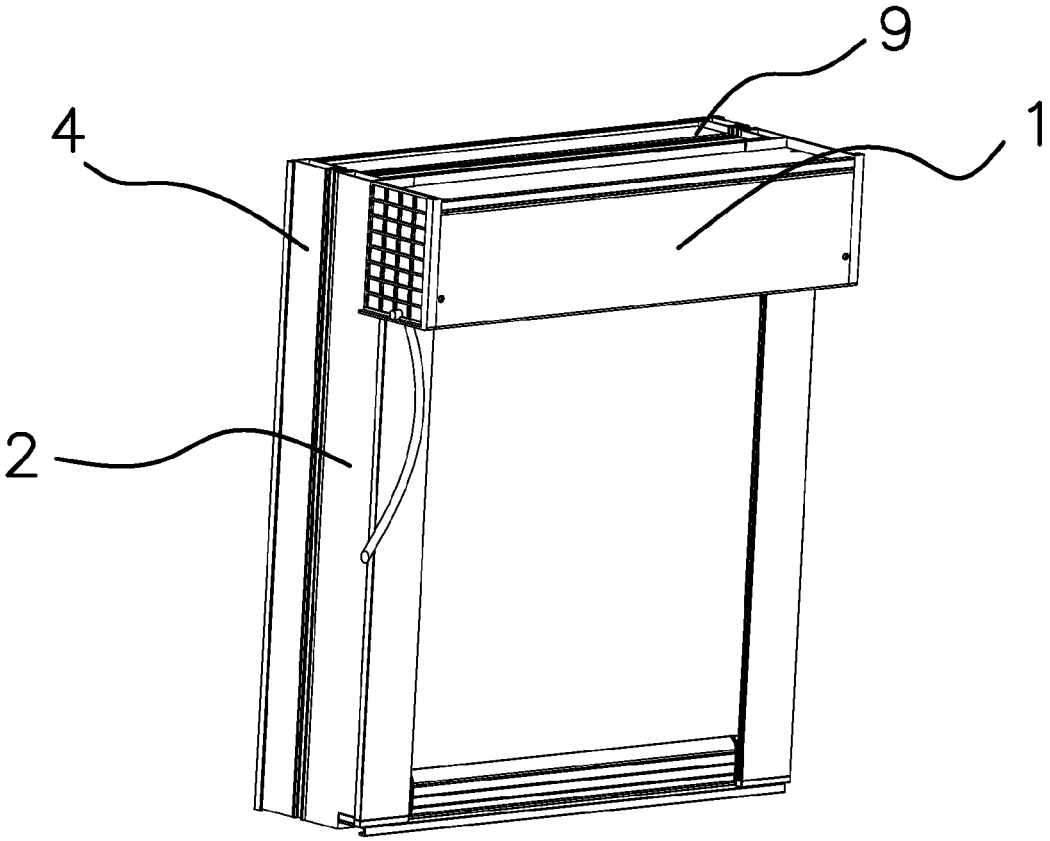
FIG. 18 is a schematic diagram of the integrated multi-function window according to the third embodiment of the invention.
Figure 19:
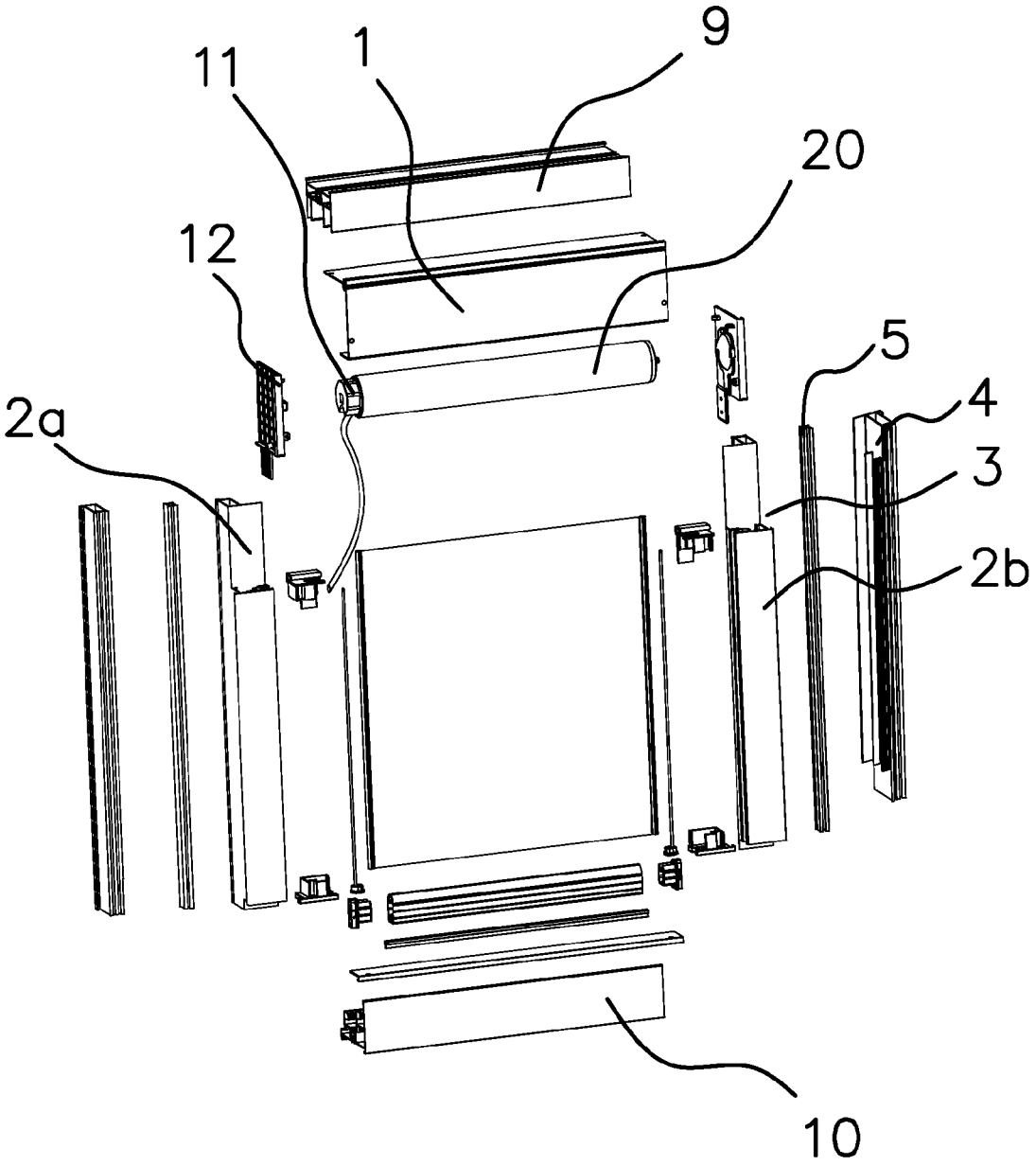
FIG. 19 is an exploded view of the integrated multi-function window according to the third embodiment of the invention.

As shown in FIGS. 18 and 19, the structures and principles of the third embodiment are substantially the same as those of the second embodiment. The third embodiment is merely different from the second embodiment in that the indentation 3 formed between the guide portion 2*b* and the support portion 2*a* has a width smaller than that of the window cover 1, because the window frame of this embodiment is mainly applied to inner sun shading windows and the frame body 2 is located within the room and the lateral seal is located outside of the room. In other words, the window cover 1 is positioned inside the room in the third embodiment. As the lateral seals 4 and the frame bodies 2 are mounted within the wall, the frame bodies 2 can not extend beyond the wall for the purpose of attraction and harmony of the whole product. Meanwhile, the area of the window cover 1 can not be overly small as it is provided with a tubular motor. Consequently, the width of the indentation 3 formed between the guide portion 2*b* and the support portion 2*a* must be smaller than the width of the window cover 1, so that the window cover 1 individually extends beyond the wall. In the meantime, in order to prevent mosquito entering into the room when the window is opened to circulate the air, the window cloth 7 is made from screen window cloth in this embodiment.

The other aspects of the third embodiment could refer to those described in the second embodiment.

Fourth Embodiment

The fourth embodiment is different from the first, second or third embodiment in that the windproof component of the window frames employs different positioning elements. In particular, the positioning element of the fourth embodiment is implemented by a flexible tape. Both lateral edges of the curtain cloth are respectively fixedly connected with the flexible tape on the same side or both lateral edges are respectively covered on the exterior of the flexible tape on the same side, and the upper end of the flexible tape is wound around the reel pipe. A hook is provided on the bottom plug at the lower end of the guide portion. When the curtain cloth is unwound, the lower end of the flexible tape is engaged with the hook of the bottom plug to keep the curtain cloth constantly in the straightened condition. When the lower end of the flexible tape is disengaged from the hook of the bottom plug, the curtain cloth could be driven by the reel pipe to wind upwards.

The other aspects of the third embodiment could refer to those described in the first, second or third embodiment.

Fifth Embodiment

The fifth embodiment is different from the first, second, third or fourth embodiment in that the reel pipe is driven in a different manner. In particular, a rope is manually pulled to drive the curtain cloth instead of the aforesaid driving components, for example the tubular motor. In this embodiment, a bead plate is externally secured to one end of the reel pipe and is driven to rotate by a pull bead, thereby driving the reel pipe to rotate synchronously.

Sixth Embodiment

The sixth embodiment is different from the first, second, third or fourth embodiment in that the reel pipe is driven in a different manner. In particular, a rocker is manually turned to drive the curtain cloth instead of the aforesaid driving components, for example the tubular motor. The driving mode by manually turning the rocker is well known to persons having ordinary skills in the art and thus is omitted herein for brevity.

The other aspects of the third embodiment could refer to those described in the first, second, third or fourth embodiment.

The present invention has the following advantages over the prior art:

1. The front and back window covers are provided with curtain cloth, which meets the demand for sun shading outside of windows and the purpose for prevention of mosquito and sun shading. As such, the curtain cloth could be of multiple uses, meet multiple demands and have cost efficiency.

2. The present invention has a more reasonable configuration, in which the guide portion for positioning the guide rod to guide the curtain cloth to move up and down is integrated with the support portion for locating the sliding window. In addition, the front frame body and back frame body respectively provided with sliding windows are connected with each other via the plastic bars. As such, good heat insulating performance could be achieved and the window could be conveniently manufactured and mounted in the invention.

3. The window frames are made from aluminum alloy and/or plastic steel materials and have a long use life.

4. The position and connection of the front frame body relative to the back frame body could be modified as required by actual circumstances. As such, the window frames could be classified into inner sun shading window frames and outer sun shading window frames, for which the window frames could be widely employed.

5. When the wind is strong, the guide rods can be located and the hems can be covered on the guide rods and move up and down along the guide rods, which ensures and strengthens the overall windproof intensity of the window frames on the one hand, and guarantees the smoothness of the movement of the curtain cloth on the other hand.

6. A piece of cloth can be folded in two to form hems having a circumferentially closed space. When the hems are wound by the tubular motor together with the curtain cloth, the hems are pressed flat. The hems have the same thickness as the curtain cloth and always remain flat. As such, the curtain cloth is entirely and flatly wound around the aluminium tube, which overcomes the problem of the curtain cloth being displaced when the windproof curtain is wound.

The specific embodiments described herein are merely illustrative of the spirit of the invention. Various variations, modifications and amendments can be made to these embodiments by those of ordinary skills in the art without departing from the spirit or scope defined by the appended claims.

LIST OF REFERENCE NUMERALS

FIGS. 1-12

1 front window cover
2 front frame body
2*a* front support portion
2*b* front guide portion
2*c* first groove
2*d* front frame body limiting element
2*e* front indentation
3 back frame body
3*a* back support portion
3*b* back guide portion
3*c* second groove
3*d* back frame body limiting element
3*e* back indentation
4 curtain cloth
4*a* hem
5 plastic bar
6 guide rod
7 track
8 seal plug
8*a* gap
9 upper slide
10 lower slide
11 tubular motor
12 end cap
12*b* extension element
13 bottom plug
14 guide plug
15 positioning element
15*a* elliptical groove
16 aluminium pipe
17 back window cover
18 translative window sash
19 window frame sealing plate
20 lower rod
21 rubber strip
22 lower rod
23 window frame sealing plate
24 inner window frame sealing plate

FIGS. 13-19

1 window cover
2 frame body
2*a* support portion
2*b* guide portion
2*c* track
2*d* first groove
2*e* frame body limiting element
3 indentation
4 lateral seal
4*a* second groove
4*b* lateral seal limiting element
5 plastic bar
6 guide rod
7 curtain cloth
7*a* hem
8 seal plug
8*a* gap
9 upper slide
10 lower slide
11 tubular motor
12 end cap
12*b* extension element
13 bottom plug
14 guide plug
15 positioning element
15*a* elliptical groove
16 lower rod plug
17 rubber strip
18 bottom seal
19 lower rod
20 aluminium pipe

The invention claimed is:

1. An integrated multi-function window comprising a first window frame and a second window frame, the first window frame has a first window, the second window frame has a second window, and a position of the second window is corresponding to that of the first window, characterized in that, a first window cover is mounted at an upper part of the first window frame and a first telescopic curtain cloth is located within the first window cover; one side of the first window frame is fixedly connected to the second window frame, and a second telescopic curtain cloth is located within the second window cover;

a first pair of support portions and a first pair of guide portions respectively and symmetrically positioned on both sides of the first window frame, one first support portion of the first pair of support portions and one first guide portion of the first pair of guide portions on the same side are integrally molded, an upper end of the one first support portion is located higher than that of the one first guide portion, and an indentation is formed above the one first support portion and the one first guide portion on the same side; and the first window cover is mounted at the indentations on both sides of the first window frame, and the first window cover has a width identical to that of the indentation;

a second pair of support portions and a second pair of guide portions respectively and symmetrically positioned on both sides of the second window frame, one second support portion of the second pair of support portions and one second guide portion of the second pair of guide portions on the same side are integrally molded, an upper end of the one second support portion is located higher than that of the one second guide portion, and an indentation is formed above the one second support portion and the one second guide portion on the same side; the second window cover is mounted on the indentations on both sides of the second window frame, and the second window cover has a width greater than that of the indentation;

a first and second rotary reel pipe are respectively mounted within both of the first window cover and second window cover, the first telescopic curtain cloth is wound around the outer surface of the first reel pipe and the first reel pipe is turned to drive the first telescopic curtain cloth to wind or unwind; a longitudinal opening is located on the side of the one first guide portion facing the first telescopic curtain cloth; a track is provided within the one first guide portion in the longitudinal direction and forms an open slot in the longitudinal direction, the opening of the open slot face to one side of the first telescopic curtain cloth, an upper opening of the open slot is in communication with the first window cover, a positioning element is mounted within the open slot along the longitudinal direction; and both lateral edges of the first telescopic curtain cloth respectively pass through the longitudinal opening of the one first guide portion and the opening of the open slot on the same side, to extend into the open slot and be transversely positioned at the positioning element.

2. The window as claimed in claim 1, characterized in that, an upper slide is connected between the upper ends of the support portions on both sides, a lower slide is connected between lower ends of the support portions on both sides, and the upper slide is corresponding to the lower slider; the said second window frame is formed and enclosed by vertical lateral seals on both sides, the upper slide connected between the upper ends of the lateral seals on both sides and the lower slide connected between the lower ends of the lateral seals on both sides, and the upper slide is corresponding to the lower slide.

3. The window as claimed in claim 2, characterized in that, a first groove is set on one side of the support portion of the first window frame in a longitudinal direction and a second groove is correspondingly set on one side of the lateral seal of the second window frame in the longitudinal direction; and both lateral edges of a first plastic bar are respectively inserted and fixed into the first groove and second groove on the same side.

4. The window as claimed in claim 3, characterized in that, the upper slide of the said first window frame is fixedly connected with the upper slide of the said second window frame through a second plastic bar; and the lower slide of the first window frame is fixedly connected with the lower slide of the said second window frame through a third plastic bar.

5. The window as claimed in claim 3, characterized in that, a lateral seal limiting element is formed on an inner side of one of the lateral seals of the second window frame in the longitudinal direction for positioning the sliding window, and a window body limiting element is formed on an inner side of the support portion of the first window frame on the opposite side in the longitudinal direction for positioning another sliding window.

6. The window as claimed in claim 1, characterized in that, the positioning element is a guide rod, the lower end of the guide rod is fixed and the upper end thereof faces opposite to the interior of the said first window cover; and both lateral edges of the first telescopic curtain cloth are respectively covered on the exterior of the guide rod on the same side and could be driven by the first reel pipe to move up and down along the guide rod.

7. The window as claimed in claim 6, characterized in that, each of the lateral edges of the first telescopic curtain cloth is fixedly connected with a hem, the first telescopic curtain cloth and the hems can be welded together by using a heat sealing device under temperature of 200-400° C. or sewed to each other by using a sewing machine; the first telescopic curtain cloth is transversely located at the guide rod through the hems.

8. The window as claimed in claim 1, characterized in that, a tubular motor is mounted within the said first reel pipe and drives the first reel pipe to rotate.

9. The window as claimed in claim 6, characterized in that, a bottom plug is fixedly connected with the lower end of the one first guide portion, a positioning element is mounted in the bottom plug, and an elliptical groove is disposed on the positioning element, the lower end of the guide rod is fixed in the elliptical groove.

10. The window as claimed in claim 1, characterized in that, the lower edge of the first telescopic curtain cloth is connected with a lower rod, after passing through the longitudinal opening of the one first guide portion and the opening of the open slot on the same side, both ends of the lower rod slidably extend into the open slot, and the length of the lower rod coincides with the distance between the positioning elements on both sides.

11. The window as claimed in claim 10, characterized in that, a concave slot is formed on a lower surface of the lower rod along its length, the slot is embedded into the rubber strip and the rubber strip partially projects from the lower surface of the lower rod.

* * * * *